US008083555B2

(12) United States Patent
Schouten

(10) Patent No.: US 8,083,555 B2
(45) Date of Patent: Dec. 27, 2011

(54) JUMPER CABLE CLAMP

(75) Inventor: Pieter Schouten, Berkeley, CA (US)

(73) Assignee: Hopkins Manufacturing Corporation, Emporia, KS (US)

( * ) Notice: Subject to any disclaimer, the term of this patent is extended or adjusted under 35 U.S.C. 154(b) by 0 days.

(21) Appl. No.: 12/791,973

(22) Filed: Jun. 2, 2010

(65) Prior Publication Data

US 2010/0304621 A1 Dec. 2, 2010

Related U.S. Application Data

(60) Provisional application No. 61/183,109, filed on Jun. 2, 2009.

(51) Int. Cl.
*H01R 11/24* (2006.01)

(52) U.S. Cl. ..... 439/822

(58) Field of Classification Search ..... 439/822, 439/726, 759, 754, 729, 506, 755
See application file for complete search history.

(56) References Cited

U.S. PATENT DOCUMENTS 2,522,810 A * 9/1950 Bailey ..... 439/729
2,644,142 A * 6/1953 Danberg ..... 439/224
4,153,321 A 5/1979 Pombrol
4,453,791 A 6/1984 Ledbetter
4,758,188 A 7/1988 Yates
4,781,629 A 11/1988 Mize
4,826,457 A 5/1989 Varatta
4,926,722 A 5/1990 Sorensen et al.
5,002,508 A 3/1991 Craveiro
5,009,134 A 4/1991 Sorensen et al.
5,021,008 A 6/1991 Scherer
5,022,137 A 6/1991 Sorensen et al.
5,170,682 A 12/1992 Sorensen et al.
5,222,420 A 6/1993 Sorensen et al.
5,326,076 A 7/1994 Sorensen et al.
5,377,567 A 1/1995 Sorensen
D361,745 S 8/1995 Geroux et al.
5,456,144 A 10/1995 Dahl et al.
5,503,049 A 4/1996 Chervenak et al.
5,601,452 A 2/1997 Ruffa
5,603,643 A 2/1997 Krivec
5,772,468 A 6/1998 Kowalski et al.
5,775,680 A 7/1998 Sorensen et al.
6,238,253 B1 * 5/2001 Qualls ..... 439/759
6,336,386 B1 1/2002 Lee
6,347,565 B2 2/2002 Steinweg
6,638,101 B1 10/2003 Botelho
(Continued)

*Primary Examiner* — Phuong Dinh
(74) *Attorney, Agent, or Firm* — George R. McGuire; David B. Woycechowsky; Bond Schoeneck & King, PLLC

(57) ABSTRACT

One aspect of the present invention is a jumper cable clamp that is biased to a position with its jaws open. Another aspect of the present invention is a jumper cable clamp that uses biases open its jaws using torsional tension in a helical spring. Another aspect of the present invention is a jumper cable clamp that includes a set of jaws, a jaw-biasing hardware set and a ratchet hardware set where: (i) the jaw-biasing hardware set biases the jaws towards an open position; and (ii) the ratchet hardware set holds the position of the jaws at regular positional increments as the jaws are moved, against the bias provided by the jaw-biasing hardware set, towards a closed position. Preferably, the ratchet hardware set further includes a quick release mechanism structured, located, sized, shaped and/or mechanically connected to release a ratcheted engagement of the ratchet hardware set upon activation of the quick release mechanism.

3 Claims, 10 Drawing Sheets

U.S. PATENT DOCUMENTS 6,708,587 B1 3/2004 Noniewicz et al.
6,711,338 B2 3/2004 Lin et al.
6,711,789 B2 * 3/2004 Ping ..... 24/505
6,860,179 B2 3/2005 Hopper et al.
6,871,387 B2 3/2005 Cheng et al.
6,910,915 B2 6/2005 Kutteruf
7,354,302 B1 4/2008 Walker
7,389,978 B2 6/2008 Rowlay et al.
7,611,373 B1 * 11/2009 LaSalvia ..... 439/394
7,637,753 B2 12/2009 Wong et al.
7,740,510 B2 6/2010 Muz
2001/0012738 A1 8/2001 Duperret et al.
2005/0160567 A1 7/2005 Liou
2005/0250390 A1 11/2005 MacDonald
2006/0223384 A1 10/2006 Schuh
2010/0275740 A1 11/2010 Norin

* cited by examiner

JUMPER CABLE CLAMP

RELATED APPLICATION

The present application claims priority to U.S. provisional patent application No. 61/183,109, filed on 2 Jun. 2009; all of the foregoing patent-related document(s) are hereby incorporated by reference herein in their respective entirety(ies).

BACKGROUND OF THE INVENTION

1. Field of the Invention

The present invention relates to clamps for booster or jumper cables to be used in conjunction with vehicle batteries. The present invention is not related to the kind of "jumper cables" used for logic bearing circuit boards, such as the "jumper cables" discussed in U.S. Pat. No. 6,711,338.

2. Description of the Related Art

Booster or jumper cables with clamps are conventional. In these conventional clamps, the jaws of the clamp are rotationally biased toward a closed position. In operation, the user squeezes insulated handles together to overcome the rotational bias and to rotate the jaws of the clamp open so that they can accommodate a battery terminal therebetween. When the user has maneuvered the open clamp into position, jaws around the terminal, then she releases the handles and allows the rotational bias to close the jaws of the clamp back up again. The bias force secures the clamp on the terminal and thereby provides the electrical connection between the jaw and the terminal. Preferably, the bias force is relatively large so that an electrical connection will be reliably established and maintained even if there is dirt or non-conductive deposit on the respective contacting surfaces of the jaw and/or terminal.

U.S. Pat. No. 4,153,321 ("Pombrol") discloses a battery booster cable clamp including a ratchet mechanism. Regarding its ratchet mechanism, 321 Pombrol states: "At the rear end of the arm 23 is a flexible member 45 extending upward in an arcuate manner. Flexible member 45 contains thereon a plurality of serrations 46. The end of the arm 15 contains thereon a projection 47 to engage these serrations 46. This establishes the ratchet mechanism. The flexible member 45 is of a thickness such that it will be slightly flexible and is molded so as to be biased against the arm 15. However, application of force in the direction of the arrow 49 will remove the serrations 46 from engagement with the projection 47 to permit free movement of the arm 15 with respect to the arm 23". Pombrol does not disclose that the jaws of its jumper cables are biased toward the open position and also does not disclose that the jaws of its jumper cables are biased toward the closed position.

U.S. Pat. No. 6,638,101 ("Botelho") discloses a jumper cable clamp that operates similarly to a vice grip type pliers. Botelho states: "A pivot section 22 connects the jaws 18 to the handle 20. The handle section 20 has a release 24 that can open the jaws 18 when they are locked closed and is formed such that the handle section 20 on each clamp 12 can be closed and locked by pressing together the handle section 20 with a single hand. With this design, little hand strength is required to close the clamp 12, and opening the clamp only requires the user to open the release 24". Botelho further states: "The jaws 18 are used to connect to a battery terminal or automotive chassis and can be opened by exerting pressure on the handle section 20; they will open 1, 2, 3, 4 or more inches and preferably open widely enough for easy movement and attachment to the battery terminal. A pivot section 22 connects the jaws 18 to the handle 20. The handle section 20 also comprises a release lever 24 located on the side of the handle section 20 that does not contain the electrical cable 14. Flipping the release lever 24 causes the jaws 18 to open when they are locked closed". Botelho does not disclose that the jaws of its jumper cables are biased toward the open position and also does not disclose that the jaws of its jumper cables are biased toward the closed position.

Some prior art publications which may be of interest may include the following US patents: (i) U.S. Pat. No. 5,775,680 ("Sorensen 8"); (ii) U.S. Pat. No. 5,503,049 ("Chervenak"); (iii) U.S. Pat. No. 5,456,144 to Dahl et al. ("Dahl"); (iv) U.S. Pat. No. 5,377,567 to Sorensen ("Sorensen 1"); (v) U.S. Pat. No. 5,326,076 to Sorensen et al ("Sorensen 2"; (vi) U.S. Pat. No. 5,222,420 to Sorensen et al. ("Sorensen 3"); (vii) U.S. Pat. No. 5,170,682 to Sorensen et al ("Sorensen 4"); (viii) U.S. Pat. No. 5,022,137 to Sorensen et al ("Sorensen 5"); (ix) U.S. Pat. No. 5,009,134 to Sorensen et al ("Sorensen 6"); (x) U.S. Pat. No. 4,926,722 to Sorensen et al ("Sorensen 7"; (xi) U.S. Pat. No. 7,389,978 to Rowlay et al. ("Rowlay"); (xii) U.S. Pat. No. 4,826,457 to Varatta ("Varatta"); (xiii) U.S. Pat. No. 5,772,468 to Kowalski et al ("Kowalski"); (xiv) U.S. Design Pat. No. D361,745 to Geroux et al ("Geroux"); (xv) U.S. Pat. No. 4,758,188 to Yates ("Yates"); (xvi) U.S. Pat. No. 4,453,791 to Ledbetter ("Ledbetter"); and/or (xvii) U.S. Pat. No. 7,637,753 to Wong et al ("Wong") and/or (xviii) U.S. Pat. No. 5,601,452 to Ruffa ("Ruffa").

Description of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

One aspect of the present invention is a jumper cable clamp that is biased to a position with its jaws open. Another aspect of the present invention is a jumper cable clamp that biases open its jaws using torsional tension in a helical spring. Another aspect of the present invention is a jumper cable clamp that includes a set of jaws, a jaw-biasing hardware set and a ratchet hardware set where: (i) the jaw-biasing hardware set biases the jaws towards an open position; and (ii) the ratchet hardware set holds the position of the jaws at regular positional increments as the jaws are moved, against the bias provided by the jaw-biasing hardware set, towards a closed position. Preferably, the ratchet hardware set further includes a quick release mechanism structured, located, sized, shaped and/or mechanically connected to release a ratcheted engagement of the ratchet hardware set upon activation of the quick release mechanism.

In some preferred embodiments of the present invention, the jumper cable includes: (i) first and second jaw portions (with at least one jaw portion being made of an electrically conductive material); and (ii) first and second pivoting portions that are made of plastic and rotatably mechanically connected (see DEFINITIONS section) to each other. In these preferred embodiments, the first and second jaw portions are respectively mechanically connected to ends of the first and second pivoting portions. At least some of these preferred embodiments will further include a ratcheting hardware set (including a ratcheted member) and a cable securing contact. In some of these preferred embodiments, the ratcheting hardware is rigidly mechanically connected to the first pivoting portion and the cable securing contact is mechanically connected to the second pivoting portion so that the ratcheted member and the cable securing contact are spaced apart from each other.

Various embodiments of the present invention may exhibit one or more of the following objects, features and/or advantages:

(i) easier to operate jumper cable clamp;

(ii) jumper cable clamp with improved electrical connection to the battery terminal;

(iii) jumper cable clamp with improved mechanical connection to the battery terminal;

(iv) jumper cable clamp that allows clamping and unclamping operations to be performed more quickly and reliably; and (v) jumper cable clamp that is durable and/or inexpensive to make.

According to an aspect of the present invention, a jumper cable clamp includes: a first moveable portion; a second moveable portion; a first jaw portion; a second jaw portion; a jumper cable contact; and an urging-toward-open biasing hardware set. The jumper cable contact is mechanically connected to the first moveable portion. The jumper cable contact is electrically connected to the first jaw portion and forms a suitable electrical contact for a jumper cable. The first jaw portion is mechanically connected to the first moveable portion. The second jaw portion is mechanically connected to the second moveable portion. The first moveable portion is mechanically connected to the second moveable portion so that the first jaw portion is movable with respect to the second jaw portion between a first open position and a first closed position. The urging-toward-open biasing hardware set is structured, located and/or connected to bias the first and second moveable portions to move relative to each other so that the first jaw portion and second jaw portion move toward the first open position.

According to a further aspect of the present invention, a jumper cable clamp includes: a first moveable portion; a second moveable portion; a first jaw portion; a second jaw portion; a jumper cable contact; an urging-toward-open biasing hardware set; and a position-securing hardware set. The jumper cable contact is mechanically connected to the first moveable portion. The jumper cable contact is electrically connected to the first jaw portion and forms a suitable electrical contact for a jumper cable. The first jaw portion is mechanically connected to the first moveable portion. The second jaw portion is mechanically connected to the second moveable portion. The first moveable portion is mechanically connected to the second moveable portion so that the first jaw portion is movable with respect to the second jaw portion between a first open position and a first closed position. The urging-toward-open biasing hardware set is structured, located and/or connected to bias the first and second moveable portions to move relative to each other so that the first jaw portion and second jaw portion move toward the first open position. The position-securing hardware set is structured, located and/or mechanically connected to hold the first and second moveable portions with respect to each other against the biasing force of the urging-toward-open hardware set.

According to a further aspect of the present invention, a jumper cable assembly includes: a first moveable portion; a second moveable portion; a first jaw portion; a second jaw portion; a first urging-toward-open biasing hardware set; a third moveable portion; a fourth moveable portion; a third jaw portion; a fourth jaw portion; a second urging-toward-open biasing hardware set; and a first jumper cable. The first jumper cable is electrically connected to provide an electrical current path from the first jaw portion to the third jaw portion. The first jaw portion is mechanically connected to the first moveable portion. The second jaw portion is mechanically connected to the second moveable portion. The first moveable portion is mechanically connected to the second moveable portion so that the first jaw portion is movable with respect to the second jaw portion between a first open position and a first closed position. The first urging-toward-open biasing hardware set is structured, located and/or connected to bias the first and second moveable portions to move relative to each other so that the first jaw portion and second jaw portion move toward the first open position. The third jaw portion is mechanically connected to the third moveable portion. The fourth jaw portion is mechanically connected to the fourth moveable portion. The third moveable portion is mechanically connected to the fourth moveable portion so that the third jaw portion is movable with respect to the fourth jaw portion between a second open position and a second closed position. The second urging-toward-open biasing hardware set is structured, located and/or connected to bias the third and fourth moveable portions to move relative to each other so that the third jaw portion and fourth jaw portion move toward the second open position.

BRIEF DESCRIPTION OF THE DRAWINGS

The present invention will be more fully understood and appreciated by reading the following Detailed Description in conjunction with the accompanying drawings, in which.

Cross hatching is omitted on the cross sectional views.

DETAILED DESCRIPTION OF THE INVENTION

Figure 1:
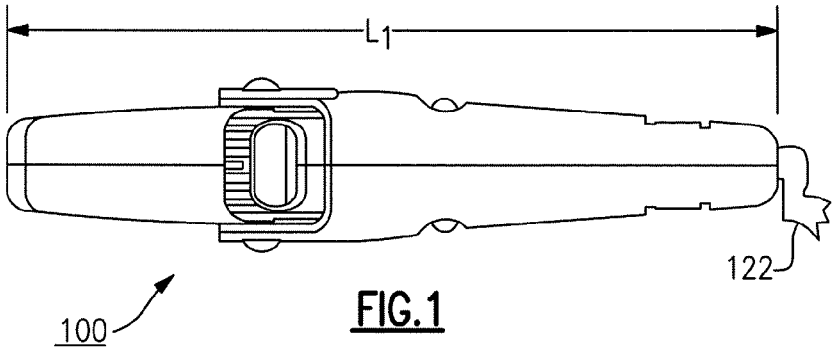
FIG. 1 is a top orthographic view of an assembly including a jumper cable and a first embodiment of a jumper cable clamp according to the present invention.
Figure 2:
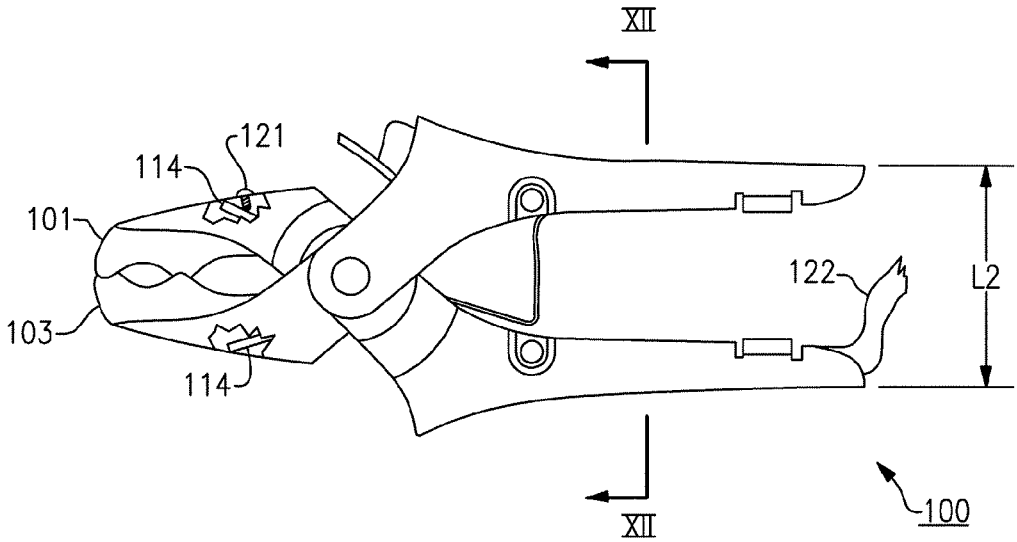
FIG. 2 is a side orthographic view of the FIG. 1 jumper cable clamp assembly with the first embodiment jumper cable claim in the closed position.
Figure 3:
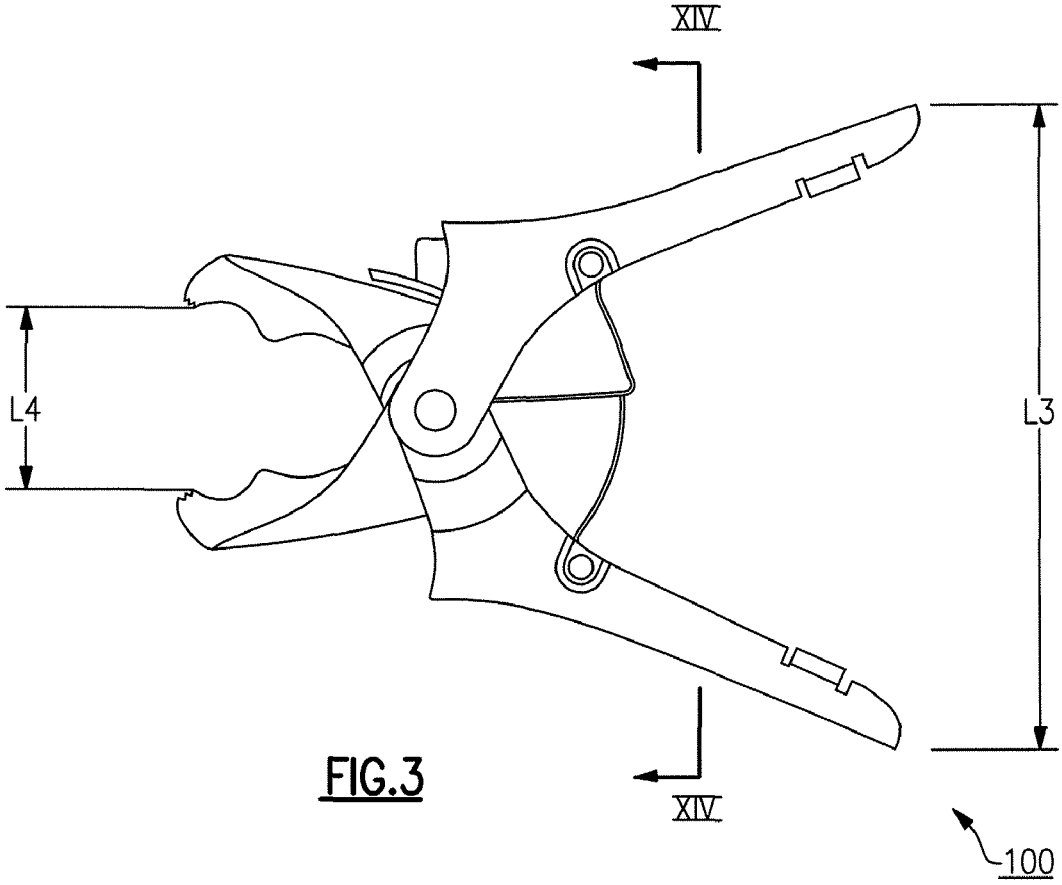
FIG. 3 is a side orthographic view of the FIG. 1 jumper cable clamp assembly with the first embodiment jumper cable claim in the open position.

FIGS. 1-3, 5-14 and 19-22 show jumper cable clamp assembly, including: upper jaw member 101 (including jumper cable guide portion 101*a*); quick release button 102; lower jaw member 103; upper handle 104; outer ratchet member 108; ratchet-spring 110; inner ratchet member 112; jaw spring 114; jaw spring pintle 116; lower handle 120; jumper cable contact 121; jumper cable 122; cable guide 124 and support members 126, 128, 130, 132. As shown in FIGS. 2 and 3, the jaws of the clamp can be rotated with respect to each other between a fully closed position (FIG. 2) and a fully open position (FIG. 3). When a user uses the clamp, the user may not open the clamp all the way to the fully open position, or close the clamp to the fully closed position. Still, the user generally will open the clamp to a sufficiently open position so that the jaws can be placed around a battery terminal, or other grippable object, and will close the clamp to a sufficiently closed position so that the clamp will grip the battery terminal or other grippable object. As used herein, the term "open position" will be used to refer to any relatively open position, and the term "closed position" will be used to refer to any relatively closed position.

In assembly 100, the general overall geometry of the clamp is similar to that of a pair of scissors or a pair of pliers, just like the general, overall geometry of a conventional biased-closed jumper cable clamp. This general geometry can be thought of as having two opposing movable portions and two opposing jaw portions. Each jaw portion is preferably, respectively located at the front end of one of the pivoting portions. It is noted that these moveable portions and these jaw portions can be made up as a varying number of separate piece parts, depending upon the clamp designer's design choices. For example, the jaw portions and the moveable portions could be accomplished in as few as two separate piece-parts, specifically: (i) a first unitary piece-part for the first moveable portion (with the first jaw portion formed integrally therein); and (ii) a second unitary piece-part for the second moveable portion (with the second jaw portion formed integrally therein). This is not necessarily a preferred design—among other issues this design would carry a risk of shock for any human user.

Figure 7:
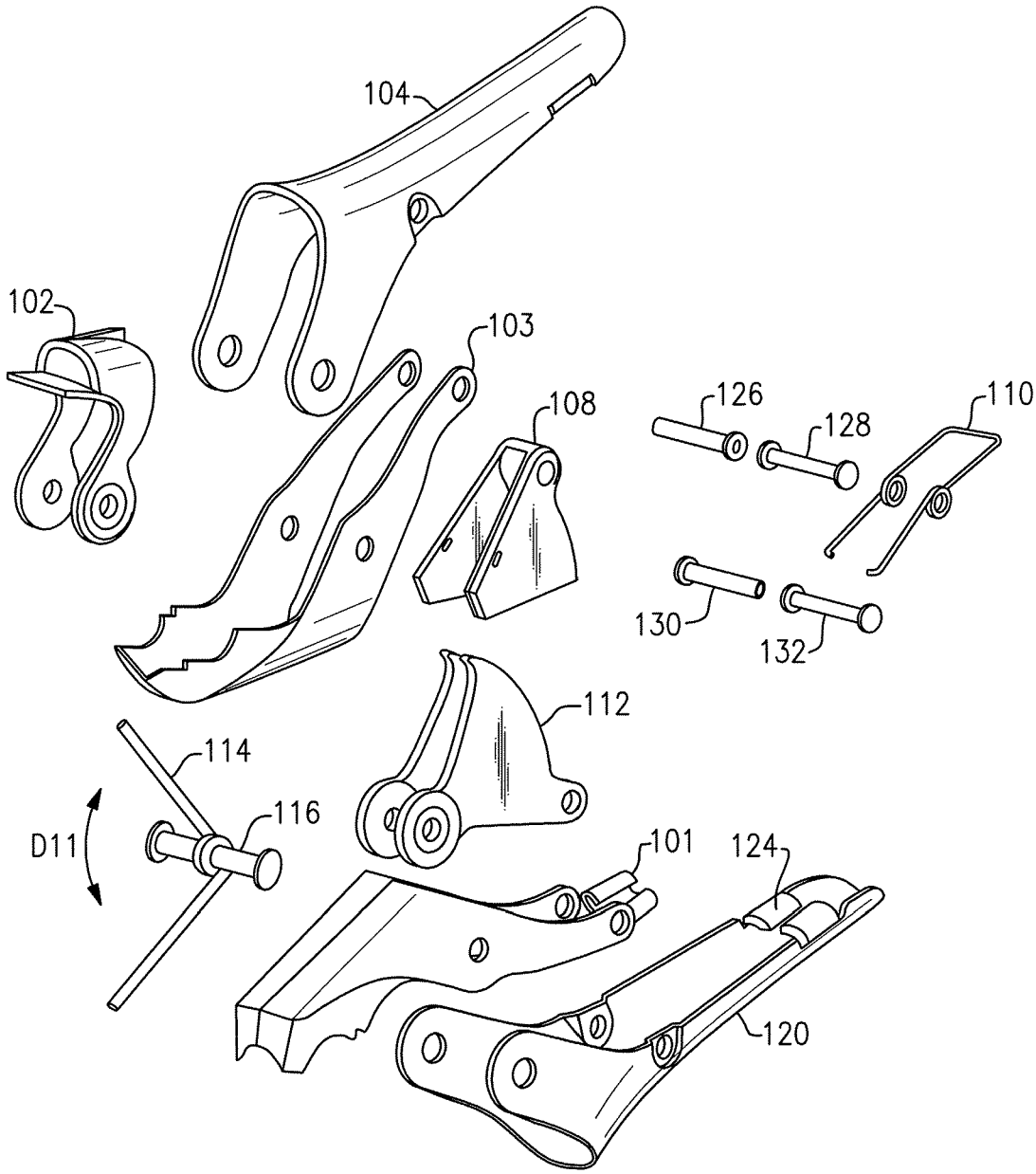
FIG. 7 is an exploded perspective view of the first embodiment clamp.
Figure 8:
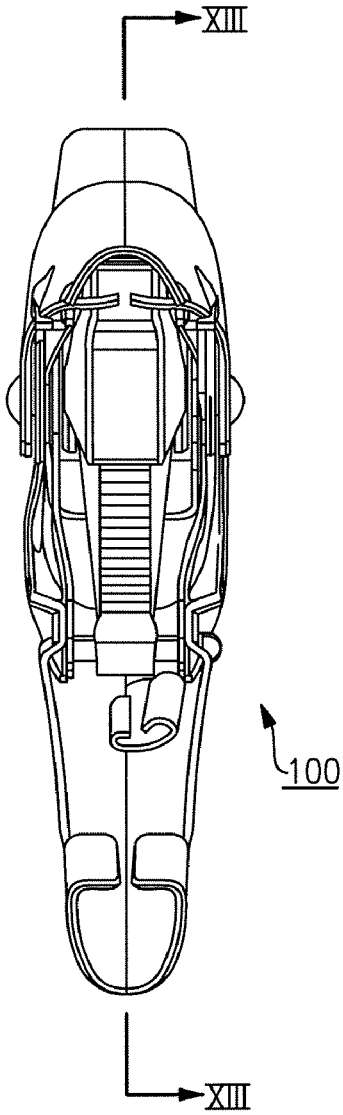
FIG. 8 is an orthographic rear view of the first embodiment clamp in the open position.
Figure 9:
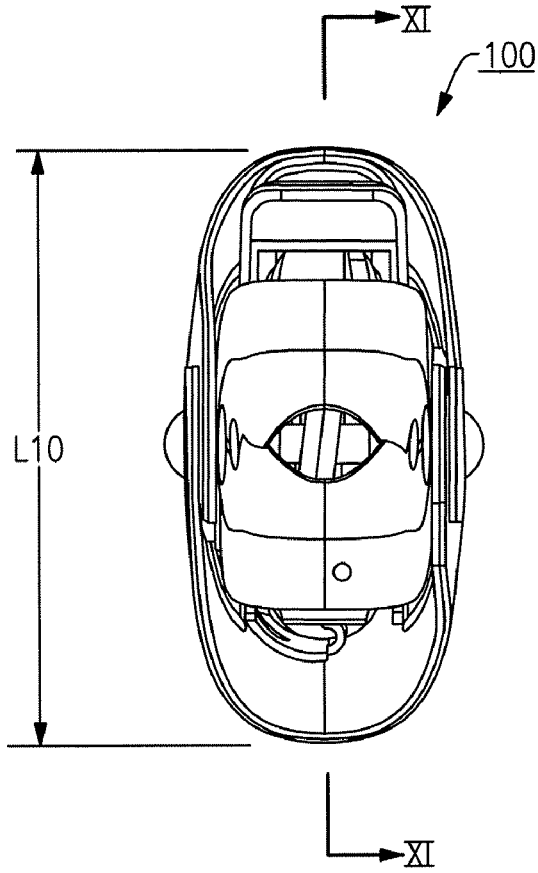
FIG. 9 is an orthographic rear view of the first embodiment clamp in the closed position.
Figure 10:
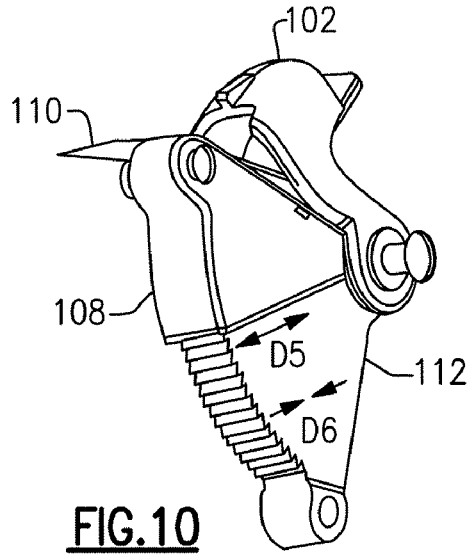
FIG. 10 is a perspective view of a portion of the first embodiment clamp.
Figure 11:
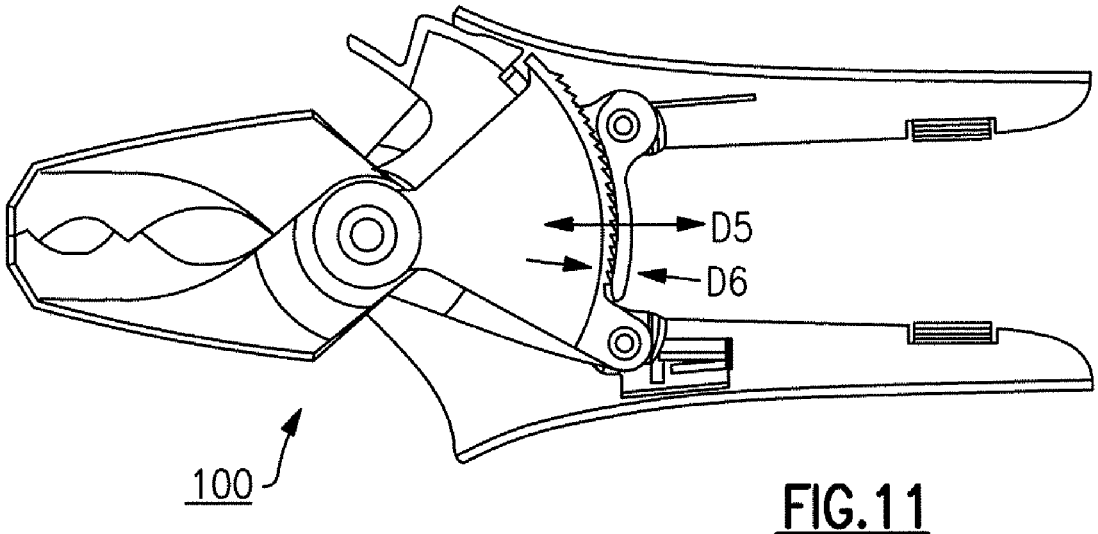
FIG. 11 is a cross-sectional view of the first embodiment jumper cable clamp in the closed and engaged position.
Figure 12:
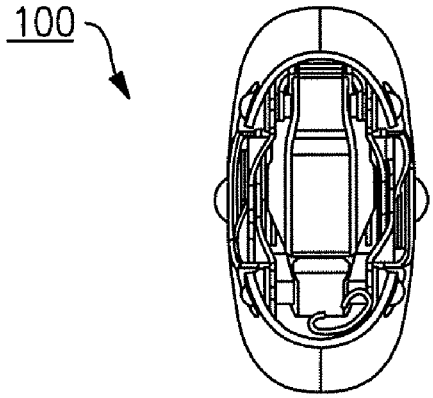
FIG. 12 is an orthographic rear view of the first embodiment clamp in the closed position.
Figure 13:
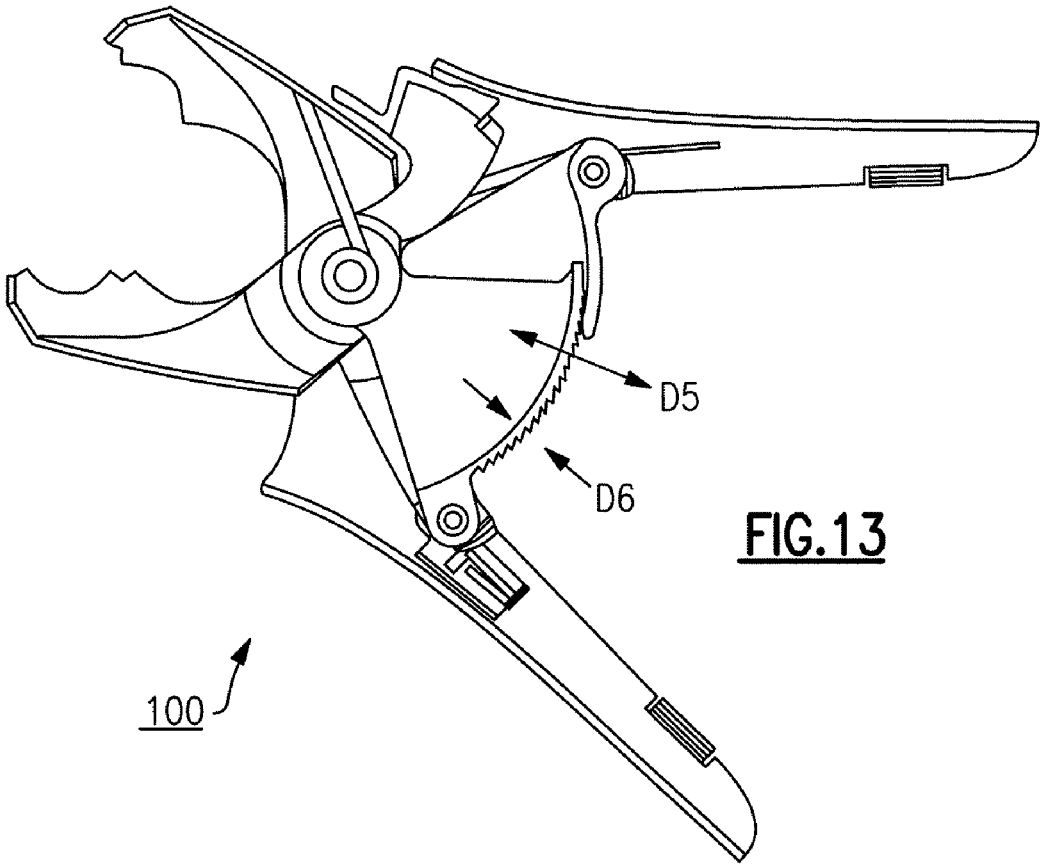
FIG. 13 is a cross-sectional view of the first embodiment jumper cable clamp in the open and disengaged position.
Figure 14:
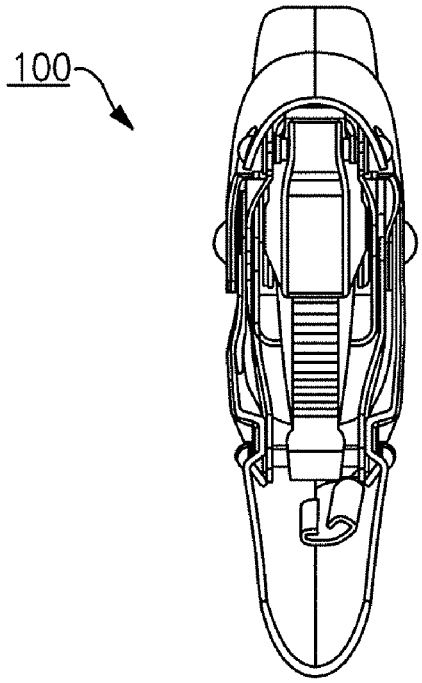
FIG. 14 is a cross-sectional view of the first embodiment jumper cable clamp in the open position.

As an example of a different design, according to the present invention, with respect to the moveable portions and jaw portions, the clamp of assembly 100 has four piece-parts making up the jaw portions and pivoting portions, as best shown in FIG. 7. More particularly, in this clamp: (i) the first moveable portion is made up two piece-parts, specifically lower handle 120 and most of the body of upper jaw 101; (ii) the second moveable portion is made up of two piece-parts, specifically upper handle 104 and most of the body of lower jaw 103; (iii) the first jaw portion is made up of the serrated edge located at the front end of upper jaw 101; and (iv) the second jaw portion is made up of the serrated edge located at the front end of lower jaw 103. In other embodiments of the present invention, the moveable portions and the jaw portions geometry may be split among and between piece-parts in still other ways.

It is also noted that the jaw portions do not have to have a serrated edge, although at least one of the jaw portions will generally have to be electrically conductive so that current may flow through the jaw to and/or from the jumper cable contact and the jumper cable that is intended for connection to the jumper cable contact. In the embodiment of assembly 100, jumper cable contact 121 (see FIG. 2—contact 121 is omitted from other Figures for clarity of illustration purposes) takes the form of a metal which is screwed right through the material of metal upper jaw 101, and is thereby forms an electrical connection with the jaw portion of upper haw 101. The body of screw 121 forms a surface for receiving the end of a jumper cable. Alternatively, the contact hardware may take other forms, such as a sub-assembly including a screw and a metal plate that is sized and shaped to be secured to the body of the screw and to extend into the space between the insulative coating of a jumper cable and the conductors inside of the jumper cable.

It is noted that the moveable portions, the respective jaw portions and/or the mechanical connection between the moveable portions and the respective jaw portions do not have to be rigid or formed or connected as a single contiguous body. As will be further discussed in connection with the embodiment of FIG. 18, the basic geometry of the moveable portions and the respective jaw portions does not necessary have to be a scissors type geometry, although a scissors-type geometry is generally preferred. As will be further discussed in connection with the embodiment of FIG. 17, the basic geometry of the moveable portions and the respective jaw portions does not necessary have to be a pivoting geometry at all, so long as the jaw portions can move between a relatively open position and a relatively closed position, although a pivoting scissors-type geometry is generally preferred.

Figure 5:
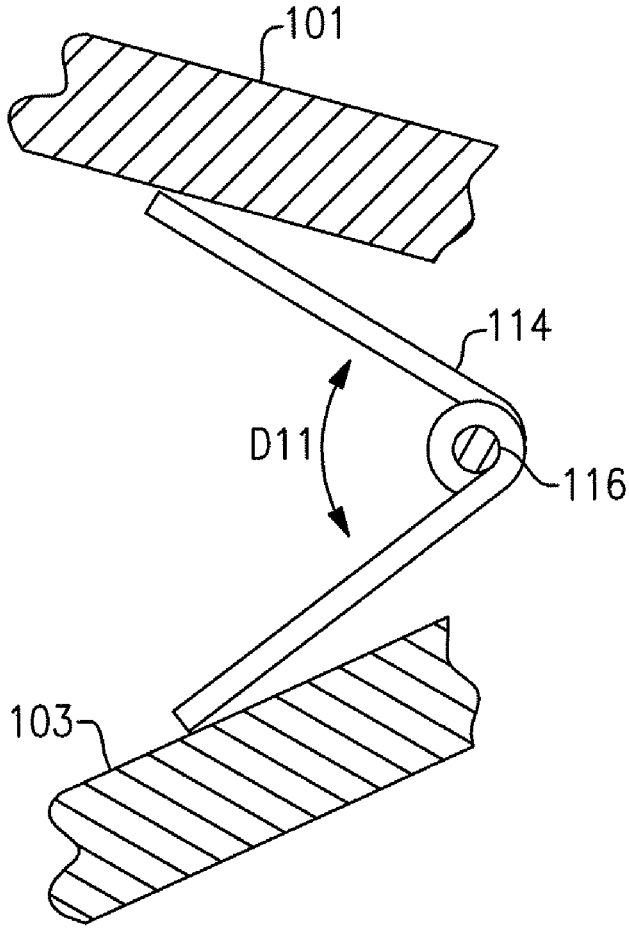
FIG. 5 is a cross-sectional view of a portion of the first embodiment clamp in the open position.
Figure 6:
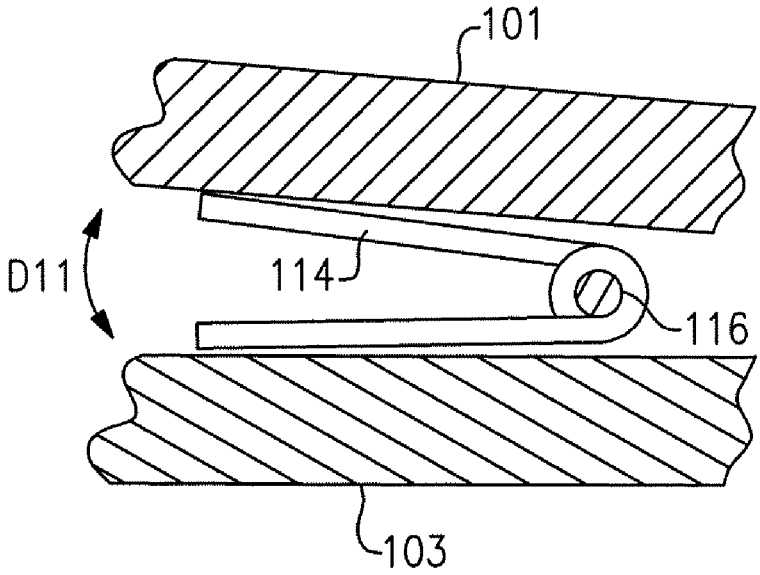
FIG. 6 is a cross-sectional view of a portion of the first embodiment clamp in the closed position.

The bias-open feature of the clamp of assembly 100 will now be discussed. The bias-open feature is best seen in FIGS. 2, 5 and 6, and it involves the interaction of upper jaw member 101, lower jaw member 103 and helical spring 114. As shown in FIG. 5, helical spring 114 has two arms that are torsionally biased apart in rotational direction D11. As further shown in FIG. 5, one of these arms tends to spread into contact with upper jaw member 101 and the other arm tends to spread into contact with lower jaw member 103. In this way, the torsional tension in the helical spring biases the clamp towards an open position. As shown in FIG. 2, the clamp has been squeezed to the fully closed position by a user (not shown), thereby forcing the arms of helical spring 114 rotationally towards each other in the counter-DU direction. As will be further discussed below, the ratcheting hardware set of the clamp of assembly 100 will hold the clamp in the fully closed position (or in one of many relatively closed positions) against the open-direction biasing of helical spring 114. For this reason, once a user squeezes the clamp to a closed position, the user may release the clamp and it will remain closed (for example, closed about a terminal post in an automotive battery).

It is noted that other torsionally tensioned helical spring geometries, or even other completely different types of biasing hardware can provide the urging-toward open biasing force in other clamp embodiments according to the present invention. It is further noted that not all embodiments of the present invention will necessarily have the above-mentioned ratcheting hardware set.

The bias-open feature of the present invention (especially when used in conjunction with hardware that can hold the clamp in a closed position against its urging-toward-open bias) makes jumper cables easier and more reliable to use. For example, in some embodiments of the present invention, the biasing force may be made weaker (that is, less stiff and easier to overcome by human hand applied force) than in a comparable, conventional urging-toward-closed clamp. This makes it easier for a user to manipulate the clamp by applying smaller forces to it during operation. Also, the bias-open feature allows the closing operation to be done in a carefully controlled manner, as compared to the closing that may be (purposely or inadvertently) effected in a sudden manner in conventional urging-toward-closed clamps. This can be advantageous because it is the closing of the clamp that is generally performed in the confined and difficult-to-access space under the hood of a motor vehicle, and is performed in proximity to surfaces that could cause electrical shorts (for example, the wrong terminal of the automotive battery or another clamp from the jumper cables that was previously affixed to some other portion of the motor vehicle). By requiring the user to squeeze the clamp shut (as opposed to forcing it open and then releasing it in the correct time and at the correct location), the closing operation can be performed by the user in a more cautious, reliable and deliberate manner.

Preferred embodiments of the present invention also include some kind of position-securing hardware that will temporarily hold the clamp in a relatively closed position against the urging-toward-open biasing force discussed above. One exemplary kind of a position-securing hardware set is the ratcheting hardware set of assembly 100. As shown in FIGS. 7, 8, 10, 11, 13, 14, 21 and 22, this ratcheting hardware set includes the following components: quick release button 102; outer ratchet member 108; ratchet-spring 110; and inner ratchet member 112.

In this embodiment, the inner ratchet member is a tooth-bearing member with teeth projecting in the radial direction from its arc-shaped outer radial surface, and the outer ratchet member is a tooth receiving member with an inner, arc-shaped radial surface shaped to engage with the teeth of the inner ratchet member. In this embodiment, the inner ratchet member is rigidly mechanically connected to lower handle 120, as best shown in FIGS. 2, 7, 13 and 22. In this embodiment, the outer ratchet member is rotationally mechanically connected to upper handle 104, as best shown in FIGS. 2, 7, 13 and 22. Ratchet-spring 110 is connected to bias the rotating outer ratchet member in the direction D6 (see FIGS. 11 and 13) towards a position of engaging with the teeth of the inner ratchet member. This biasing force, provided by the ratchet-spring, keeps the ratchet hardware set engaged, so that the clamp is held against its urging-toward-open bias, as a user squeezes the clamp from the open position toward the closed position. For example, if the user releases her squeezing pressure on the clamp in the middle of the process of squeezing it shut, then the first and second jaw members will maintain their relative rotational positions until the user resumes her squeezing because: (i) the ratchet spring maintains the engagement of the ratchet teeth; and (ii) the engagement of the ratchet teeth prevents the first and second jaw and handle members from moving toward the open position, despite the torsion bias imparted by jaw spring 114.

The inner and outer ratchet members are shaped so that the clamp can be moved toward the closed position, even when the teeth are engaged—this one-way type of permissible motion is well known in the field of ratchet design. In operation, the user continues to manipulate the clamp toward further closed positions until the jagged, gripping edges of the jaw members make a mechanical and electrical connection with the appropriate portions of a motor vehicle (for example, the battery terminals). The ratchet engagement will firmly hold a tight grip even after the user releases her squeezing pressure. the co-operative efforts of the bias-open related hardware and the position-securing hardware make the task of fixing a jumper cable clamp to a battery terminal, or other target, easier, more reliable and pleasant to perform.

When the clamp is to be released from the object to which it is fixed (for example, a battery terminal), quick release button 102 and the bias-open related hardware co-operate to facilitate this release. More specifically, as shown in FIGS. 7, 10, 11 and 21, the quick release button is rotationally mechanically connected with respect to upper handle 104 by jaw spring pintle 116. When a user pushed the quick release button 102 back into outer ratchet member 108, the outer ratchet member is forced to rotate with respect to upper handle 104 about its pivoting connection therewith. This rotational motion of the outer ratchet member causes the inner and outer ratchet members to move separate, generally in the direction of arrows D5. This separation disengages the ratchet teeth engagement. Once the ratchet engagement is disengaged, the upper jaw member 101/lower handle 120 are free to rotate with respect to lower jaw member 103/lower handle 120 in the direction of arrow D11 under the biasing influence of jaw spring 114. This means that the jaws of the clamp move back to an open position without any further action by the user, except for the pushing of the quick release button. When the user releases quick release button 102, ratchet spring 110 will again force the outer ratchet member to move with respect to the inner ratchet member, in the direction of arrows D6 so that the ratcheting hardware becomes engaged once again, and the clamp will once again hold its intermediate and/or closed position(s) as the clamp in the process of being squeezed shut by the user.

Some (not necessarily) preferred embodiments of the present invention have an urging-toward-open, but no sort of positional-securing hardware (see, for example, discussion of clamp 400, below), the user has to maintain clamp-closing force for as long as the clamp is to be connected to the battery terminal. This is non-preferred because it is not optimally safe to hold a clamp during a boost operation. Also, a typical jump start includes four battery terminals respectively clamped by four clamps, but a typical user has but two hands for clamp squeezing. Other, alternative position-securing hardware includes a locking set pin or latch, or other user-activated lock hardware that a user could activate to lock the relative position jaws in one or more possible engaged positions. Whatever the position-securing hardware, it is preferable that it allows the clamp to be engaged in many, different, incremental intermediate positions, as opposed to one, or a few, positions. One reason that ratchet-type hardware is preferred position-securing hardware is because it also the clamp to be engaged in many, many different incremental positions between fully open and fully closed.

Some exemplary dimensions (in millimeters unless otherwise noted) for clamp assembly 100 will now be set forth: (i) L1=162.75; (ii) 48.01; (iii) 126.03; (iv) 36.21; (v) L5=162.75;

(vi) L6=68.6; (vii) L7=48.01; (viii) L8=36.21; (ix) L9=126.03; and (x) L10=68.6.

In the first embodiment, the upper and lower jaw members are preferably made of electrically conductive metal. The upper and lower handle members are preferably made of metal coated with an electrically insulative material, such as a thin layer of rubber.

Figure 17:
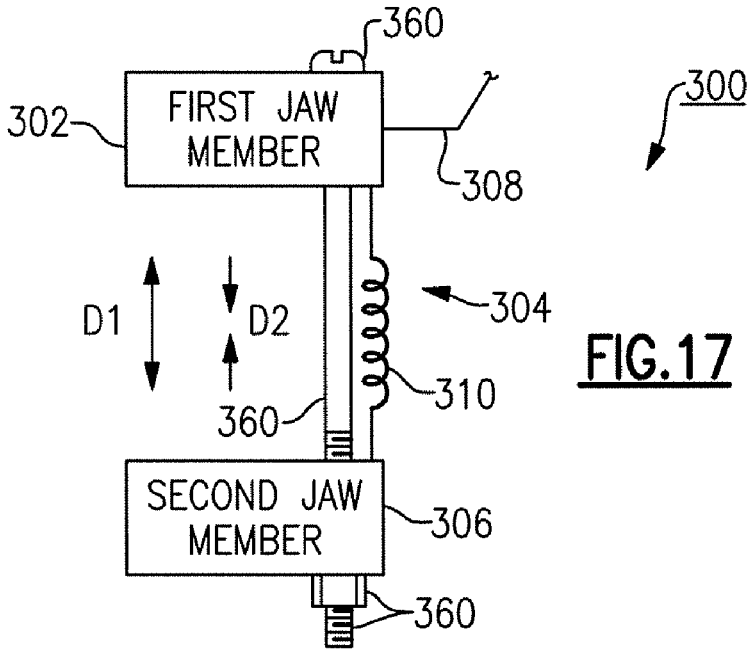
FIG. 17 is a schematic view of a fourth embodiment of a jumper cable clamp according to the present invention.

FIG. 17 shows clamp 300 including: first jaw member 302; connection hardware set 304; second clamp jaw 306; and jumper cable contact line 308. The connection hardware set includes spring 310 and nut-and-bolt sub-assembly 360. Spring 310 provides the urging-toward-open bias. Nut-and-bolt assembly 360 provides position-securing hardware that allows a user to hold the clamp in a relatively closed position, against the bias of the spring, by rotating the nut of the nut-and-bolt sub-assembly. Clamp 300 is not necessarily a preferred embodiment of the present invention, but is included here to show some of the possible scope of the present invention. It is noted that the relative movement of the jaw members (directions D1 and D2) and the urging-toward-open bias of the spring (that is direction D1 bias) are linear in direction in this embodiment, as opposed to angular or rotational.

Figure 18:
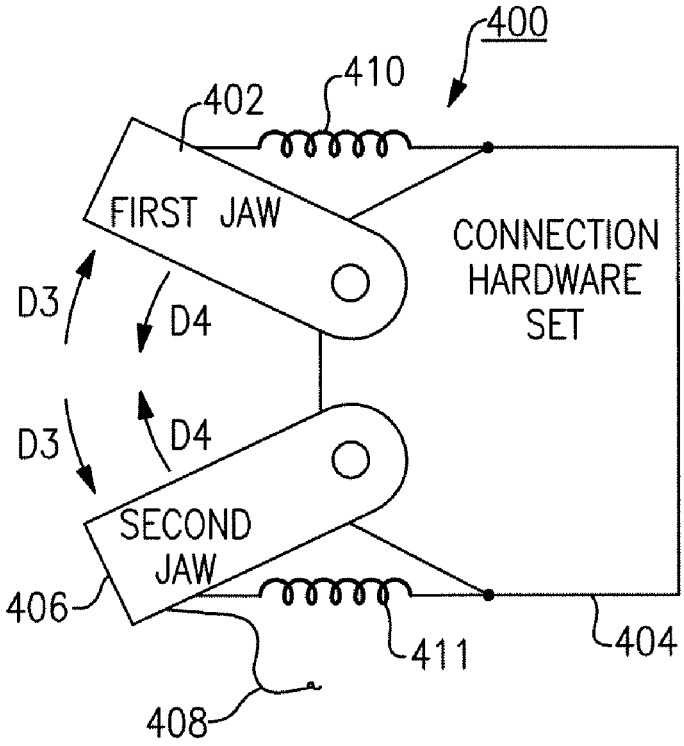
FIG. 18 is a schematic view of a fifth embodiment of a jumper cable clamp according to the present invention.
Figure 19:
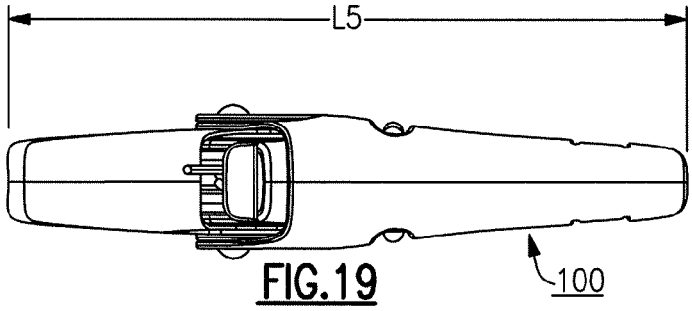
FIG. 19 is an orthographic top view of the first embodiment clamp.
Figure 20:
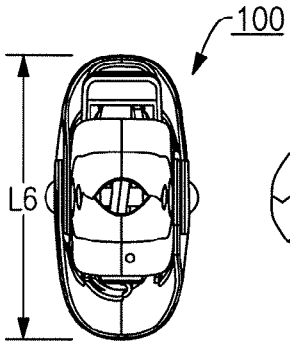
FIG. 20 is a cross-sectional view of the first embodiment clamp.
Figure 21:
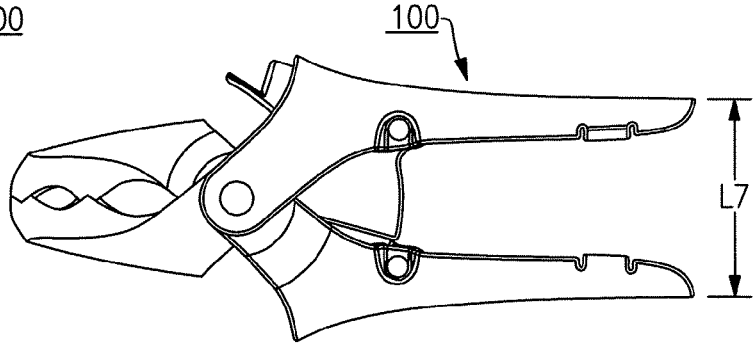
FIG. 21 is an orthographic side view of the first embodiment clamp in the closed position.
Figure 22:
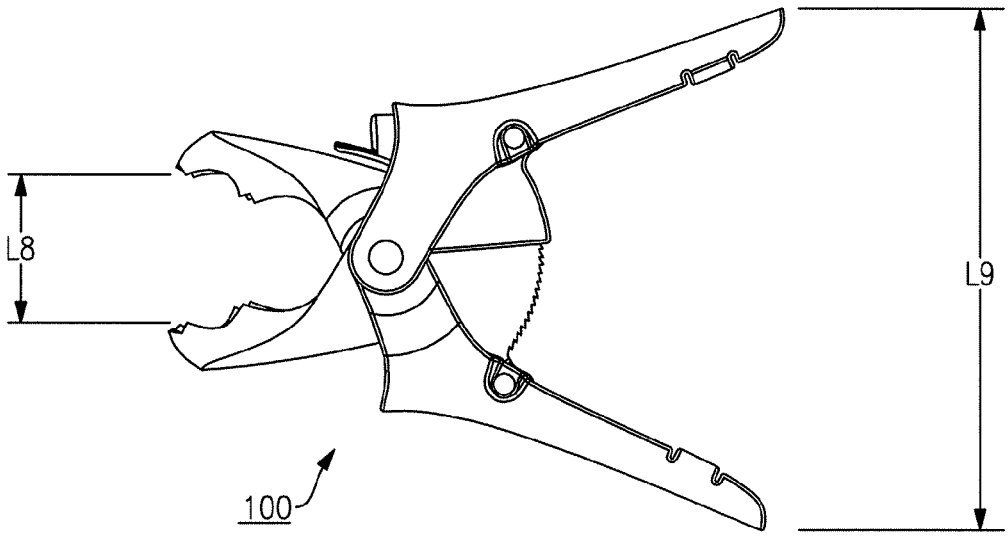
FIG. 22 is an orthographic side view of the first embodiment clamp in the open position.

FIG. 18 shows clamp 400 including: first jaw member 402; connection hardware set 404; second clamp jaw 406; and electrical connection 408. The connection hardware set includes bias hardware set 410, 411. It is noted that the open-direction bias (that is direction D3 bias) is rotational in this embodiment, but that the jaws do not rotate about a common rotational axis. It is also noted that the bias hardware set in this example includes two springs, rather than just one. It is noted that the springs in this example exert a linear directed (as contrasted with torsionally directed) pulling force to provide the urging-toward-open bias. Alternatively, the biasing force could be applied to a single jaw and the other jaw could be made to be rotationally fixed. Clamp 400 does not include any position-securing hardware, so clamp 400 would need to be maintained in a closed position either manually, or by some type of extraneous hardware, such as a rubber band placed around the distal ends of the first and second clamp jaws. Clamp 400 is not necessarily a preferred embodiment of the present invention, but is included here to show some of the possible scope of the present invention.

Figure 4:
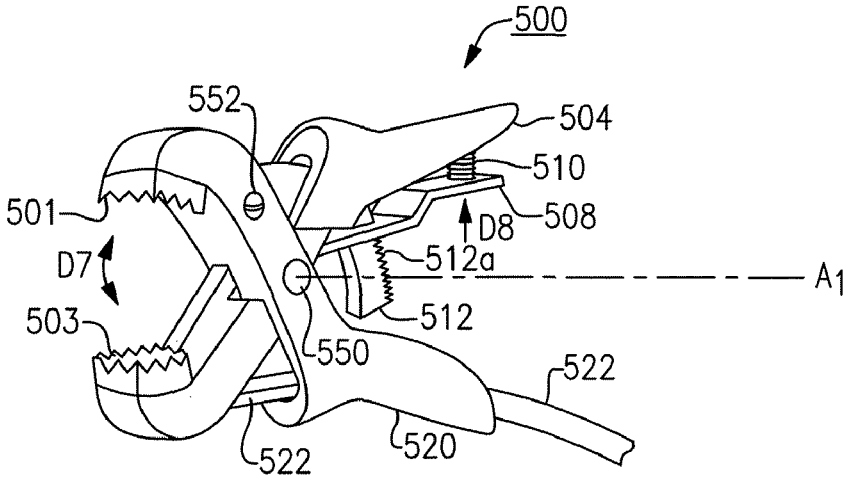
FIG. 4 is a perspective view of the FIG. 1 an assembly including a jumper cable and a second embodiment of a jumper cable clamp according to the present invention.

FIG. 4 shows preferred clamp assembly 500 including: first jaw member 501; second jaw member 503; first Z-shaped member 520; second Z-shaped member 504; tooth-receiving member 508; ratchet spring 510; tooth-bearing member 512 (including teeth 512*a*); jumper cable 522; pivot axis screw 550; and ratchet hardware securing screw 552 Like the clamp of assembly 100, this clamp of assembly 500 also has a generally scissors type geometry. However, in this embodiment the first and second moveable portions are respectively formed as unitary, plastic, single piece-parts, specifically first and second Z-shaped members 520,504. The jaw members are made of metal, and second jaw member 503 is electrically connected to the conductor of jumper cable 522 by jumper cable contact hardware (not shown). The clamp of assembly 500 is biased towards and open position by hardware similar to that identified and discussed in connection with the clamp of assembly 100.

The clamp of assembly 500 has position-securing hardware including: tooth-receiving member 508; ratchet spring 510; tooth-bearing member 512 (including teeth 512*a*); and ratchet hardware securing screw 552. The arc-shaped tooth-bearing member is rigidly mechanically connected to the first Z-shaped member by ratchet hardware securing screw 552 so that the arc is substantially concentric with the central axis defined by pivot axis screw 550. Tooth-receiving member 508 is an elongated member that is rotationally mechanically connected at one of its ends to second Z-shaped member 504. Ratchet spring 510 is under compressive tension and biases the other end of tooth-receiving member 508 in the counter-D8 direction so that the tooth-receiving member engages with the teeth of the tooth-bearing member to provide the position-securing functionality. When a user wants to disengage the positional securement provided by the ratchet engagement, then the user presses the tooth-receiving member 508 in the D8 direction which rotates the tooth-receiving member to a position which is disengaged from the ratchet teeth of tooth-bearing member 512.

It is noted that the tooth-bearing member is connected to the opposite Z-shaped member from the Z-shaped member having the jumper cable contact, and the ratchet hardware securing screw 552 and tooth-bearing member are spaced well away from the jaw member of the opposite Z-shaped member to prevent physical interference in the moving parts. This is one reason that the pivoting members in this embodiment can be reliable made from unitary plastic parts, which saves on materials and manufacturing costs. It is further noted that the tooth-bearing member and the tooth-receiving member in the clamp embodiment of assembly 500 have relatively simple and easy-to-manufacture geometries.

Figure 15:
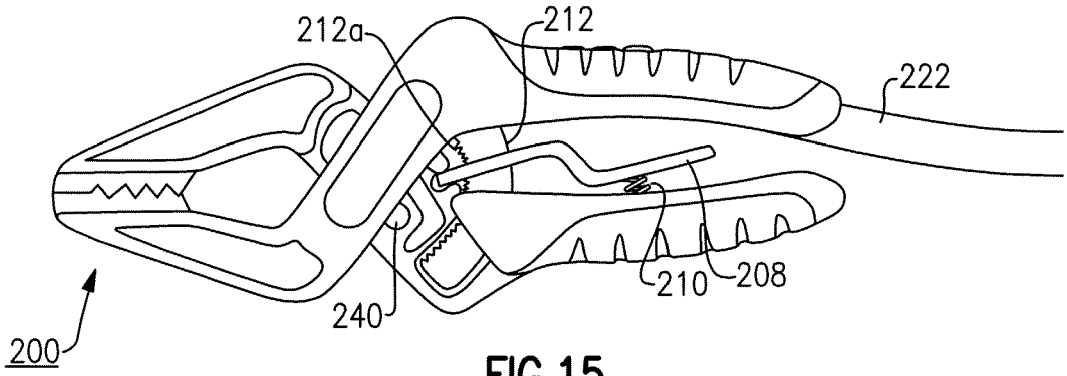
FIG. 15 is a side orthographic view of an assembly including a jumper cable and a third embodiment of a jumper cable clamp according to the present invention in the closed position.
Figure 16:
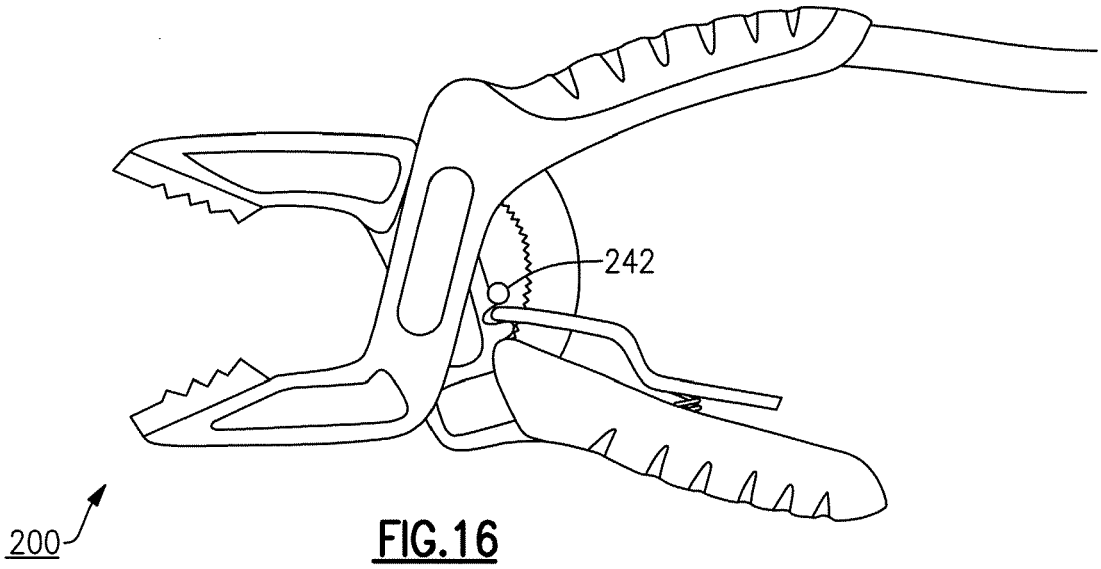
FIG. 16 is a side orthographic view of the assembly of FIG. 15 with the third embodiment jumper cable in the open position.

FIGS. 15 and 16 show clamp assembly 200 according to the present invention, including tooth-receiving member 208; ratchet spring 210; tooth-bearing member 212 (including teeth 212*a*); jumper cable 222; first Z-shaped member 240; and pivoting connection hardware 242. Assembly 200 is largely similar to assembly 500, discussed above. FIG. 16 shows exemplary pivoting connection hardware for rotationally mechanically connecting tooth-receiving member 208 to the second Z-shaped member (no separate reference numeral). One difference between assembly 200 and assembly 500 is that the teeth face radially inwards, rather than radially outwards. Another difference is that the Z-shaped members have somewhat different angles and proportions. Another difference is that the tooth-bearing member has a longer arc-length in the clamp of assembly 200, which means that care must be taken so that there is not physical interference between the tooth-bearing member and the Z-shaped member opposite the Z-shaped member that the tooth-bearing member is rigidly connected to.

DEFINITIONS

Any and all published documents mentioned herein shall be considered to be incorporated by reference, in their respective entireties, herein to the fullest extent of the patent law. The following definitions are provided for claim construction purposes:

Present invention: means at least some embodiments of the present invention; references to various feature(s) of the "present invention" throughout this document do not mean that all claimed embodiments or methods include the referenced feature(s).

First, second, third, etc. ("ordinals"): Unless otherwise noted, ordinals only serve to distinguish or identify (e.g., various members of a group); the mere use of ordinals implies neither a consecutive numerical limit nor a serial limitation.

Electrically Connected: means either directly electrically connected, or indirectly electrically connected, such that intervening elements are present; in an indirect electrical connection, the intervening elements may include inductors and/or transformers.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, force fit connections, friction fit connections, connections secured by engagement added by gravitational forces, quick-release connections, pivoting or rotatable connections, slidable mechanical connections, latches and/or magnetic connections); mechanically connections also include things that are integrally formed together as a single piece-part; for example, if a pivoting member includes a pivoting portion and a jaw portion are formed as a single piece-part from a single hunk of metal, then the pivoting portion and the jaw portion are "mechanically connected" to each other.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control.

What is claimed is:

1. A jumper cable clamp comprising:

a first moveable portion;

a second moveable portion;

a first jaw portion;

a second jaw portion;

a jumper cable contact; and an urging-toward-open biasing hardware set;

wherein:

the jumper cable contact is mechanically connected to the first moveable portion;

the jumper cable contact is electrically connected to the first jaw portion and forms a suitable electrical contact for a jumper cable;

the first jaw portion is mechanically connected to the first moveable portion;

the second jaw portion is mechanically connected to the second moveable portion;

the first moveable portion is mechanically connected to the second moveable portion so that the first jaw portion is movable with respect to the second jaw portion between a first open position and a first closed position;

the urging-toward-open biasing hardware set is structured, located and/or connected to bias the first and second moveable portions to move relative to each other so that the first jaw portion and second jaw portion move toward the first open position;

a pivoting hardware set;

a first handle member;

a first jaw-bearing member comprising a first portion and a second portion;

a second handle member; and a second jaw-bearing member comprising a first portion and a second portion;

wherein:

the jumper cable contact is mechanically connected to the first moveable portion;

the jumper cable contact is electrically connected to the first jaw portion and forms a suitable electrical contact for a jumper cable;

the first jaw portion is mechanically connected to the first moveable portion;

the second jaw portion is mechanically connected to the second moveable portion;

the first moveable portion is mechanically connected to the second moveable portion so that the first jaw portion is movable with respect to the second jaw portion between a first open position and a first closed position;

the urging-toward-open biasing hardware set is structured, located and/or connected to bias the first and second moveable portions to move relative to each other so that the first jaw portion and second jaw portion move toward the first open position;

the pivoting hardware set mechanically connects the first moveable portion to the second moveable portion so that the first and second moveable portions can rotate with respect to each other so that the first and second jaw portions move between the first open position and the first closed position;

the first movable portion comprises a first pivoting member which is elongated and has a first end, a second end and an intermediate portion located between the first end and the second end;

the second movable portion comprises a first pivoting member which is elongated and has a first end, a second end and an intermediate portion located between the first end and the second end;

the pivoting hardware set mechanically connects the intermediate portion of the first pivoting member to the intermediate portion of the second pivoting member to form a clamp having a scissors-type geometry;

the first pivoting member comprises the first handle member and the first portion of the first jaw-bearing member, with the first handle member and the first portion of the jaw-bearing member being rigidly mechanically connected to each other to make the first pivoting member generally Z-shaped;

the second pivoting member comprises the second handle member and the first portion of the second jaw-bearing member, with the second handle member and the second portion of the jaw-bearing member being rigidly mechanically connected to each other to make the first pivoting member generally Z-shaped;

the first jaw portion comprises the second portion of the first jaw-bearing member; and the second jaw portion comprises the second portion of the second jaw-bearing member; and the jumper cable contact comprises an electrical contact path and a contact member;

the electrical contact path forms an electrical conduction path that electrically connects the first jaw member to the contact member; and the contact member is sized and shaped to be electrically and mechanically connected to an end of a jumper cable.

2. A jumper cable assembly comprising:

a first moveable portion;

a second moveable portion;

a first jaw portion;

a second jaw portion;

a first urging-toward-open biasing hardware set;

a third moveable portion;

a fourth moveable portion;

a third jaw portion;

a fourth jaw portion;

a second urging-toward-open biasing hardware set; and a first jumper cable wherein:

the first jumper cable is electrically connected to provide an electrical current path from the first jaw portion to the third jaw portion;

the first jaw portion is mechanically connected to the first moveable portion;

the second jaw portion is mechanically connected to the second moveable portion;

the first moveable portion is mechanically connected to the second moveable portion so that the first jaw portion is movable with respect to the second jaw portion between a first open position and a first closed position;

the first urging-toward-open biasing hardware set is structured, located and/or connected to bias the first and second moveable portions to move relative to each other so that the first jaw portion and second jaw portion move toward the first open position;

the third jaw portion is mechanically connected to the third moveable portion;

the fourth jaw portion is mechanically connected to the fourth moveable portion;

the third moveable portion is mechanically connected to the fourth moveable portion so that the third jaw portion is movable with respect to the fourth jaw portion between a second open position and a second closed position; and the second urging-toward-open biasing hardware set is structured, located and/or connected to bias the third and fourth moveable portions to move relative to each other so that the third jaw portion and fourth jaw portion move toward the second open position.

3. The assembly of claim 2 further comprising:

a fifth moveable portion;

a sixth moveable portion;

a fifth jaw portion;

a sixth jaw portion;

a third urging-toward-open biasing hardware set;

a seventh moveable portion;

a eighth moveable portion;

a seventh jaw portion;

a eighth jaw portion;

a fourth urging-toward-open biasing hardware set; and a second jumper cable wherein:

the second jumper cable is electrically connected to provide an electrical current path from the fifth jaw portion to the seventh jaw portion;

the first and second jumper cables are mechanically connected to each other in a non-electrically conductive manner;

the fifth jaw portion is mechanically connected to the fifth moveable portion;

the sixth jaw portion is mechanically connected to the sixth moveable portion;

the fifth moveable portion is mechanically connected to the sixth moveable portion so that the fifth jaw portion is movable with respect to the sixth jaw portion between a third open position and a third closed position;

the third urging-toward-open biasing hardware set is structured, located and/or connected to bias the fifth and sixth moveable portions to move relative to each other so that the fifth jaw portion and sixth jaw portion move toward the third open position;

the seventh jaw portion is mechanically connected to the seventh moveable portion;

the eighth jaw portion is mechanically connected to the eighth moveable portion;

the seventh moveable portion is mechanically connected to the eighth moveable portion so that the seventh jaw portion is movable with respect to the eighth jaw portion between a fourth open position and a fourth closed position; and the fourth urging-toward-open biasing hardware set is structured, located and/or connected to bias the seventh and eighth moveable portions to move relative to each other so that the seventh jaw portion and eighth jaw portion move toward the fourth open position.

* * * * *